United States Patent [19]

Djordjevic

[11] Patent Number: 4,596,277

[45] Date of Patent: Jun. 24, 1986

[54] ADDITIVE METERING SYSTEM

[75] Inventor: Ilija Djordjevic, Windsor, Conn.

[73] Assignee: Stanadyne, Inc., Windsor, Conn.

[21] Appl. No.: 667,290

[22] Filed: Nov. 1, 1984

[51] Int. Cl.[4] ..... B65B 3/30; F02M 43/00

[52] U.S. Cl. ..... 141/98; 141/104; 141/100; 123/1 A; 123/73 AD; 222/56

[58] Field of Search ..... 141/1, 98–107, 141/210–213, 216, 392, 311, 351–362; 123/1 A, 73 AD, 198 A; 222/67, 56; 4/227

[56] References Cited

U.S. PATENT DOCUMENTS

| | | | |
|---|---|---|---|
| 3,765,568 | 10/1973 | Leifermann | 222/56 |
| 3,913,151 | 10/1975 | Kemig | 4/227 X |
| 3,999,226 | 12/1976 | Wolf | 4/227 X |
| 4,121,631 | 10/1978 | Jones | 141/27 |
| 4,253,436 | 3/1981 | Dudrey | 123/198 A |
| 4,262,710 | 4/1981 | Nomura et al. | 141/98 |
| 4,402,351 | 9/1983 | Nomura et al. | 141/98 |
| 4,440,115 | 4/1984 | Allen | 123/1 A |
| 4,462,417 | 7/1984 | Trinkwater, Jr. | 141/216 X |

FOREIGN PATENT DOCUMENTS

| | | | |
|---|---|---|---|
| 40-1911 | 1/1965 | Japan | 141/98 |

*Primary Examiner*—Stephen Marcus
*Assistant Examiner*—Ernest G. Cusick
*Attorney, Agent, or Firm*—Prutzman, Kalb, Chilton & Alix

[57] ABSTRACT

A metering pump employs a pump which is actuated by the fuel level gauge float assembly of the fuel tank to add metered quantities of an additive to the fuel tank. The quantity of metered additive is proportional to the quantity of fuel added to the tank. A container for the additive supply communicates with the fuel tank via a valve is actuated in response to the introduction of fuel into the fuel tank.

7 Claims, 6 Drawing Figures

ADDITIVE METERING SYSTEM

BACKGROUND OF THE INVENTION

This invention relates to a system for adding an additive to the fuel of an internal combustion engine. More particularly, this invention relates to a new and improved catalyst metering system for adding measured quantities of catalyst to the fuel tank of the engine for purposes of emission control.

In order to comply with governmental and environmental exhaust emission standards for diesel engines, the removal of particulate matter from diesel exhausts has become a key method for emission control. The passing of the engine exhaust through emission control traps which typically have a relatively large surface area formed by a ceramic material has been found to be an efficient and effective means for removing particulate matter from the engine exhausts. The particulate matter from the engine exhaust collects in the trap and gradually forms layers of soot. During the operational life of the engine, the soot layers continue to amass in the emission trap. If unchecked, the collected soot eventually reaches a stage wherein the exhaust passage through the trap is obstructed. Even partial obstruction of the passage can result in back pressures which detract from the engine performance. While replacement of the trap or reconditioning of the trap such as by external ignition of the soot are options, the most efficient and advantageous use of the emission trap system resides in continuously regenerating the trap while the engine is operating. An effective means for regenerating the trap is to effect combustion of the soot collected in the trap. It has been established that the addition to the diesel fuel of a catalyst such as manganese or cerium additives forming a carboxylic acid is an effective means for lowering the self-ignition temperature of the soot layer to provide trap regeneration without a requirement of external ignition. Self-regeneration of a ceramic trap at exhaust gas temperatures of less than 250° C. can be obtained.

The effectiveness of the catalyst additive/emission trap system for removing particulate matter from the exhaust of the diesel engine has resulted in a number of proposals for systems for adding the catalyst to the fuel. The quantity of catalyst required is very slight, i.e., on the order of five to six gallons for the normal 100,000 mile engine life expectation. However, because the catalyst tends to separate from diesel fuel if the fuel catalyst mixture remains unagitated for prolonged periods of time, in practice the catalyst is effective only if the catalyst is added to the fuel relatively shortly before the fuel is used. Precise metering of the catalyst is ordinarily not required.

One catalyst additive system employs a five gallon additive tank which is placed in the trunk of the vehicle and a pump is employed to pump the catalyst to the fuel tank. The fuel tank is modified to include a T-shaped mixing conduit, a check valve, and distribution pipes. The additive pump is external of the fuel tank. The pump is actuated in response to a fuel alert switch in the fuel fill pipe and a voltage which is supplied from the fuel level gauge in the fuel tank. A second additive metering system forces the catalyst additive through a metering valve into a line leading to the fuel injection pump. The action of the fuel injection pump functions to mix the fuel and the fuel additive. The fuel additive mixture which is not directly consumed by the engine is returned to the fuel tank and cooled in the tank with the aid of a heat exchanger.

The present invention is a new and improved additive metering system which provides for the addition of an additive to the fuel in the fuel tank in an efficient and reliable manner without requiring extensive modification to the fuel supply systems of the engine.

BRIEF SUMMARY OF THE INVENTION

Briefly stated, the invention in a preferred form is a metering system for adding metered quantities of a catalyst from a reservoir containing a catalyst supply to fuel in the fuel tank of an internal combustion engine. The system employs a transfer conduit which leads from the reservoir to the fuel tank. A valve is employed to selectively close the conduit to the passage of the fluid containing the catalyst. The valve is governed by an actuator which is responsive to the operational mode of the engine. A pump disposed in the fuel tank pumps the catalyst from the reservoir to the fuel tank and supplies metered quantity of the catalyst to the fuel in accordance with the quantity of fuel added to the tank. The pump is actuable in response to the change of the fuel level in the fuel tank such as may occur during the process of filling the tank with fuel.

The actuator comprises an automatic means to close the valve when the fuel tank is being filled with fuel. In one embodiment, the actuator comprises a spring loaded lever arm which is released upon removal of the cap from the fuel tank. An electrical device which closes the valve when the engine is not operating and opens the valve when the engine is operating may also be employed.

An inlet conduit having a uniform diameter closely receives an outlet conduit for longitudinal movement therein. A check valve is interposed at one end of the outlet conduit. The pump preferably includes a bellows which is contractable in accordance with the quantity of fuel added to the tank to expell a metered quantity of fuel from the outlet conduit. The contraction and expansion of the bellows is governed by a float assembly which is positionable in accordance with the level of fuel in the fuel tank. The outlet conduit preferably includes a flared end portion which receives a spring biased check valve and a connecting arm which extends from the float assembly.

An object of the invention is to provide a new and improved additive metering system for adding an additive to the fuel supply to be consumed by an internal combustion engine.

Another object of the invention is to provide a new and improved additive metering system which is compact and efficient and does not require extensive modification of existing engine fuel supply systems.

A further object of the invention is to provide a new and improved additive metering system wherein the pump and metering means may be integrated with the conventional fuel tank gauge assembly for mounting within the fuel tank.

Other objects and advantages of the invention will become apparent from the accompanying drawing and the specification.

DETAILED DESCRIPTION OF THE INVENTION

Figure 3:
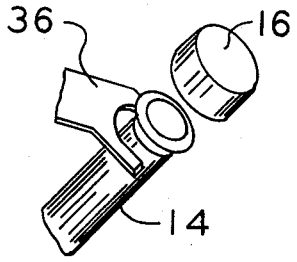
FIG. 3 is an enlarged elevational view of the additive metering system of FIG. 1 illustrating an actuating feature of the present invention.

With reference to the drawing wherein like numerals represent like parts throughout the several figures, an additive metering system is generally designated by the numeral 10. Metering system 10 is preferably employed for adding a metered quantity of a catalyst additive to the fuel in the fuel tank of an internal combustion engine. The purpos for adding the catalyst is to facilitate removal of particulate matter from diesel engine exhausts by lowering the self-ignition temperature of the soot layer which ordinarily forms in mechanical exhaust emission traps interposed in the exhaust system of the internal combustion engine. The catalyst essentially regenerates the mechanical trap by lowering the combustion temperature of the soot layer to a temperature which may be attained by merely passing the exhaust gases through the trap. Because the catalyst tends to separate from diesel fuel if the catalyst/diesel fuel mixture is left unagitated for prolonged periods of time, the addition of a catalyst to the diesel fuel is ordinarily effective to provide for efficient and reliable trap regeneration only if the catalyst is added to the fuel shortly before the fuel is consumed by the engine.

The additive metering system 10 of the present invention advantageously employs the pre-existing conventional fuel supply system of the internal combustion engine. Fuel tank 12 includes a fuel fill pipe 14 which provides access to the fuel tank for introducing fuel therein. A fuel cap 16 is rotatably secured at the terminus of pipe 14. Fuel tank 12 is also provided with an opening for receiving a fuel tank gauge unit including a gauge unit cover 20 which is mounted at opening. Excepting for the modifications described herein, a tank gauge unit cover 20 is of a conventional form which mounts a float assembly for gauging the level of fuel in the tank and also mounts conduits extending from and to the fuel tank for delivering fuel to the fuel injection pump or internal combustion engine and returning unconsumed fuel to the fuel tank.

A reservoir or container 30 for storing the catalyst additive is mounted in close proximity to fuel tank 12. The quantity of the catalyst additive required for the entire normal engine life expectation of 100,000 miles is ordinarily on the order of five to six gallons. Thus, a container 30 having a capacity on the order of five gallons would normally be sufficient to provide a lifetime supply of a suitable catalyst additive which is generally designated by the numeral 31. The container may be mounted to the vehicle by conventional means. A transfer conduit 32 leads from the bottom of container 30 to fuel tank 12. A rotary valve 34 is interposed in transfer conduit 32 to selectively close-off or open transfer conduit 32 to the flow of the catalyst additive fluid. The catalyst additive 31 is a fluid which may be any of a number of specific compositions which are suitable for lowering the combustion temperatures of soot collected in traps in the engine exhaust system (not illustrated).

Figure 1:
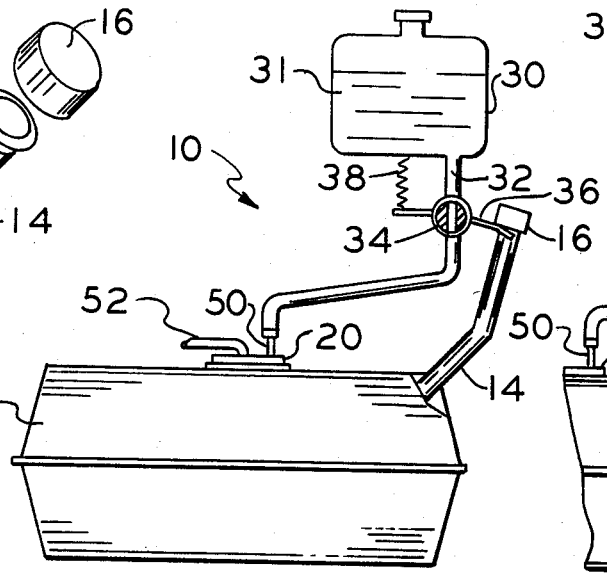
FIG. 1 is a side elevational view, partly in schematic and partly in section, illustrating the additive metering system of the present invention when the system is in the normal mode of engine operation.
Figure 2:
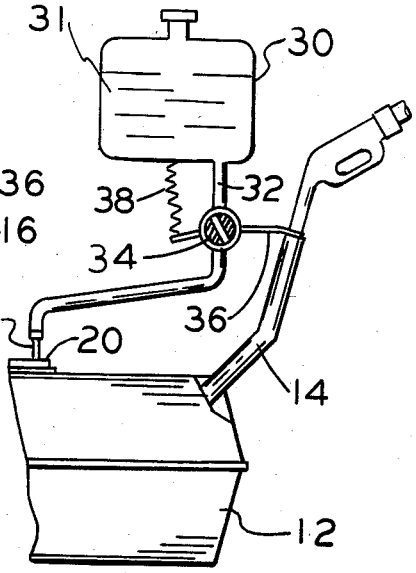
FIG. 2 is a fragmentary side elevational view, partly in schematic and partly in section, of the additive metering system of FIG. 1 illustrating the system in the fuel fill mode.

The angular position of rotary valve 34 is governed by a lever arm 36 which is biased by compression spring 38 to interact with the fuel cap 16 of the fuel tank. One end of lever arm 36 has a bifurcated structure which engages opposite bottom portions of fuel cap 16. When the fuel cap is secured in place, lever arm 36 normally forces rotary valve 34 to the open position as illustrated in FIG. 1. When the fuel cap is removed (which ordinarily occurs when the fuel tank is being filled as illustrated in FIG. 2 and FIG. 3), the spring biased lever arm 36 is released thereby forcing the rotary valve 34 to a closed or shut-off position as best illustrated in FIG. 2. Thus, during the process of filling the fuel tank, transfer conduit 32 is closed (in both directions) to the passage of the catalyst additive.

Figure 4:
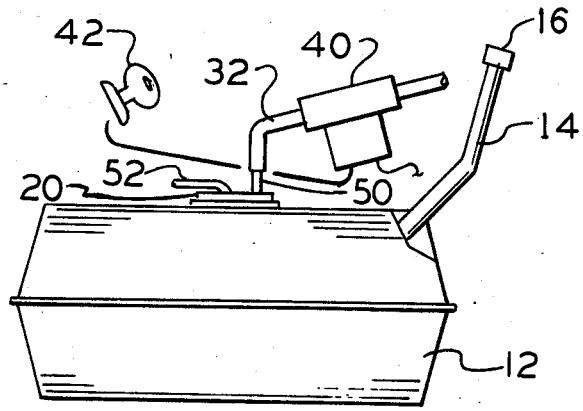
FIG. 4 is a side perspective view, partly in schematic, illustrating an alternate embodiment of the additive metering system.

Alternately, as illustrated in FIG. 4, a solenoid valve 40 may be employed to selectively open and close transfer conduit 32. The solenoid valve may be responsive to the engine ignition switch (designated generally as 42) so that when the engine is not operating, the solenoid valve 40 is opened. It will be appreciated that normally the engine is not operating while the fuel tank is being filled. Solenoid valve 40 may also be actuated by a mechanical lever arm similar to lever arm 36 or an electrical switch which opens and closes the solenoid valve in accordance with the presence or absence of the fuel cap or the introduction of fuel in the fill pipe 14. Generally, actuation in response to filling the fuel tank is preferable to prevent the inadvertent addition of catalyst due to the thermal expansion of the fuel.

Figure 5:
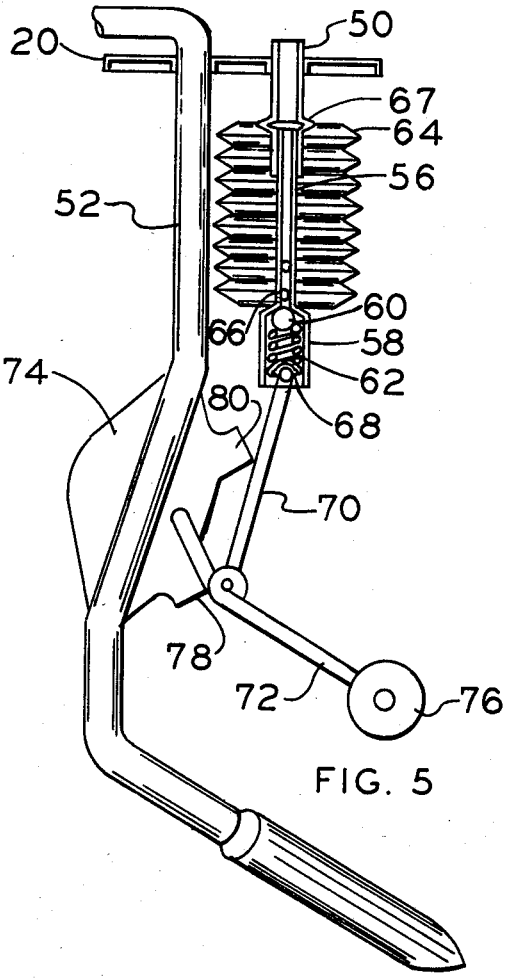
FIG. 5 is an enlarged side sectional view illustrating the pump and metering portions of the additive metering system of FIG. 1.
Figure 6:
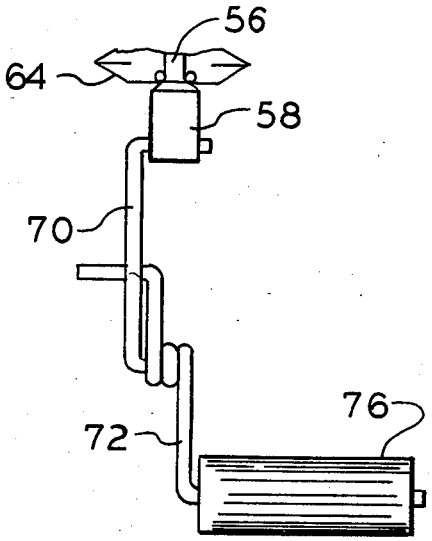
FIG. 6 is a fragmentary front elevational view of the pump and metering portions of FIG. 5.

With reference to FIGS. 5 and 6, tank gauge unit cover 20 includes an opening for receiving an inlet conduit or pipe 50 as well as an opening for accommodating the fuel line 52 leading from the fuel tank to the fuel injection pump or internal combustion engine and an opening for accommodating the return line (not illustrated) which returns fuel to the fuel tank. The bottom portion of inlet conduit 50 extends interiorly into the fuel tank and closely receives at the lower end a second outlet conduit or pipe 56 for sliding longitudinal movement therein. The interacting portions of conduits 50 and 56 have uniform diameters. The inside diameter of the receiving section of inlet conduit 50 is generally commensurate with the outside diameter of the received section of outlet conduit 56 and hence is greater than the inside diameter of the received outlet conduit 56.

In a preferred form, outlet conduit 56 has a lower integral flared portion 58 which captures a check valve 60. Check valve 60 is normally biased by spring 62 to close off the opening at the end of second conduit 56. In preferred form. conduits 50 and 56 are relatively rigid members. Inlet conduit 50 is secured in fixed position to cover 20 and connects for fluid communication with transfer conduit 32 at the upper end which is exterior of the fuel tank.

A bellows 64 is concentrically positioned relative to the inlet conduit 50 and the outlet conduit 56 and is retained in a fluid-tight engagement between a retention ring 67 of inlet conduit 50 and the variably vertically positionable flared portion of outlet conduit 56. Bellows 64 is vertically longitudinally expandable and contractable in accordance with the vertical position of outlet conduit 56 relative to inlet conduit 50. Outlet conduit 56 further includes a plurality of radial openings 66 which provide fluid communication with the interior of bellows 64. Transfer conduit 32 connects with inlet conduit 50 to provide a fluid path for the flow of the catalyst additive 31 from container 30 through outlet conduit 56 and ultimately past check valve 60 to combine with the fuel in the fuel tank.

A connecting rod 70 pivotally connects to a support platform 68 at the lower end of spring 62 opposite check valve 60 to vertically retain the outlet conduit 56. Connecting rod 70 is pivotally connected at its lower end to a float arm 72 which functions to govern the vertical position of connecting rod 70. Excepting for the pivotal connection with connecting rod 70, float arm 72 may be a component of a conventional float assembly which is employed to gauge the level of the fuel in the fuel tank and to relay the fuel level to a fuel gauge (not illustrated) on the instrument panel of the vehicle. In a conventional manner, a bracket 74 pivotally mounts one end of float arm 72. A float 76 at the opposite end of float arm 72 follows the level of fuel in the fuel tank, and in addition to governing the vertical position of connecting rod 70, translates the angular position of the float arm into a fuel level reading. Float arm 72 is thus angularly positionable between an empty tank stop 78 and a full tank stop 80 which are integrally formed on the bracket. Fuel gauge unit cover 20 may also mount a sender unit (not illustrated) for transmitting the fuel level reading to the instrument panel.

During the process of filling the fuel tank with fuel, the float arm 72 will follow the float 76 and the rising level of fuel upwardly thus vertically displacing the connecting rod 70 and forcing the outlet conduit into the inlet conduit. The consequent upward pressure exerted by the float arm contracts the bellows forcing a quantity of the catalyst additive to be expelled through the outlet conduit 56 and past the check valve 60 into the fuel tank. The quantity of expelled catalyst additive is substantially proportional to the differential contraction of the bellows due to the fuel level change and hence the quantity of fuel added to the fuel tank. Alternately, a flat diaphragm or rolling diaphragm pump may be employed in place of bellows 64.

Bellows 64 essentially functions as a metering pump. When valve 34 is closed and the bellows is contracted, a quantity of catalyst additive 31 is expelled through the end of the outlet conduit 56 in accordance with the opening pressure of check valve 60. When valve 34 is opened, the expansion of bellows 64 to an expanded position such as illustrated in FIG. 5 causes catalyst additive to be drawn into the bellows. The degree of expansion is proportional to the fuel level differential with reference to the fuel level at the conclusion of the last fuel filling process. Upon contraction of the bellows, the quantity of catalyst added to the fuel tank is proportional to the level of fuel at the commencement and the conclusion of the fuel filling process and hence ultimately the quantity of fuel added to the fuel tank. It should be noted that contraction of the bellows during the time that the valve 34 is open results in some of the catalyst being forced in a reverse direction back to the catalyst container 30 and not into the fuel tank 12. Consequently, contraction of the bellows due to vibration and/or thermal expansion of fuel while the engine is operating does not result in the addition of quantities of catalyst to the fuel. Successive expansion and contraction of the bellows 64 in coordination with valve 34 thus provides an efficient metering pump for pumping the catalyst additive from the container and expelling a metered quantity of the catalyst through the outlet conduit into the fuel tank. The dimensions and configuration of bellows 64 and the opening pressure of check valve 60 are selected to provide a proper proportion of the catalyst additive in relation to the quantity of added fuel.

The catalyst is added to the fuel at a very advantageous time—shortly before the fuel is consumed—and therefore separation of the catalyst/fuel mixture is minimized. Thus, the foregoing described system provides an efficient and accurate metering means for adding a metered quantity of a catalyst to the fuel at an opportune time.

The foregoing system may also be employed for metering noncatalytic additives to the fuel such as additives for enhancing fuel economy or engine performance.

An additional advantage of the foregoing described metering system is that the pump provided by the bellows in cooperation with the inlet conduit and the outlet conduit is easily adaptable for installation within the fuel tank by integrating the pump with the conventional fuel tank gauge assembly. In addition, the additive container and the valve actuating device may be relatively easily installed with the existing fuel supply system of the engine. Thus, the entire metering system is relatively compact and easily incorporated into conventional diesel engine systems.

The foregoing additive metering system has been set forth for purposes of illustration and should not be deemed a limitation of the invention herein. Accordingly, various modifications, adaptations and alternatives may occur to one skilled in the art without departing from the spirit and scope of the present invention.

What is claimed is:

1. A metering system for adding quantities of an additive contained in a reservoir to fuel in the fuel tank of an internal combustion engine comprising:
   - conduit means to provide a fluid conduit from the reservoir to the fuel tank;
   - valve means to selectively close the conduit means to the passage of a fluid;
   - actuator means to govern the valve means in accordance with the operational mode of the engine; and
   - metering pump means to pump the additive from the reservoir to the fuel tank and to meter a quantity of the additive into the fuel tank in proportion to the quantity of fuel added to the tank, said pump means comprising a first conduit and a second conduit, said second conduit being closely received in said first conduit for longitudinal movement therein and said pump means being actuable in response to a change of the fuel level in said fuel tank.

2. The metering system of claim 1 further comprising a check valve interposed at one end of said second conduit.

3. The metering system of claim 2 wherein the pump means comprises a bellows which is contractable in accordance with the level of fuel in the tank to expell a metered quantity of fuel through said second conduit.

4. The metering system of claim 3 further comprising a float means which is positionable in accordance with the level of fuel in the fuel tank, the contraction and expansion of said bellows being governed by said float means.

5. The metering system of claim 4 wherein the second conduit comprises a flared end portion, the check valve comprises a spring biased ball retained in said flared portion, and a connecting arm extends from said float means to govern the position of the second conduit.

6. In an internal combustion engine of a type having a fuel tank including a fill pipe and a removable cap, and a float assembly to gauge the level of fuel in the fuel tank, a metering pump system for adding an additive to fuel in the fuel tank comprising:

a reservoir for storing an additive supply;

a fluid conduit adapted for fluid communication between said reservoir and said fuel tank;

valve means to selectively close the fluid conduit to the passage of a fluid in event that the cap is removed from the fill pipe; and pump means communicating with said fluid conduit and adaptable for positioning within said tank, said pump means comprising a first conduit slidably receiving a second conduit and a bellows expandable and contractable in accordance with the relative longitudinal positions of said first and second conduits to release a quantity of additive into said fuel tank, said pump means being actuable by said float assembly to supply a quantity of additive from said reservoir to said fuel tank in accordance with the quantity of fuel added to the fuel tank.

7. The metering pump system of claim 6 wherein the float assembly moves to contract the bellows as fuel is being added to the fuel tank.

* * * * *